US007543651B2

(12) United States Patent
Smith et al.

(10) Patent No.: US 7,543,651 B2
(45) **Date of Patent: *Jun. 9, 2009**

(54) NON-ELASTOMER CEMENT THROUGH TUBING RETRIEVABLE SAFETY VALVE

(75) Inventors: Roddie R. Smith, Cypress, TX (US); Nathaniel H. Wagner, Spring, TX (US); George C. Duncan, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 299 days.

This patent is subject to a terminal disclaimer.

(21) Appl. No.: 11/255,349

(22) Filed: Oct. 21, 2005

(65) Prior Publication Data

US 2006/0124320 A1 Jun. 15, 2006

Related U.S. Application Data

(63) Continuation-in-part of application No. 10/853,568, filed on May 25, 2004, now Pat. No. 7,314,091.

(60) Provisional application No. 60/505,515, filed on Sep. 24, 2003.

(51) Int. Cl.
*E21B 34/10* (2006.01)

(52) U.S. Cl. ..... 166/386; 166/332.1; 166/332.8

(58) Field of Classification Search ..... 166/332.1, 166/332.6, 334.1, 332.8, 386
See application file for complete search history.

(56) References Cited

U.S. PATENT DOCUMENTS 3,845,818 A * 11/1974 Deaton ..... 166/322
3,955,623 A 5/1976 Aumann
4,495,998 A 1/1985 Pringle
4,577,694 A 3/1986 Brakhage, Jr.
4,597,445 A 7/1986 Knox (Continued)

FOREIGN PATENT DOCUMENTS

EP 1 519 005 3/2005

(Continued)

OTHER PUBLICATIONS

GB Search Report, Application No. GB0620770.8, dated Feb. 5, 2007.

(Continued)

*Primary Examiner*—David J Bagnell
*Assistant Examiner*—Robert E Fuller
(74) *Attorney, Agent, or Firm*—Patterson & Sheridan, L.L.P.

(57) ABSTRACT

The present invention generally relates to a non-elastomeric cement through tubing retrievable safety valve configured to control fluid flow through a production tubing string. In one aspect, a valve for use in a wellbore is provided. The valve includes a tubular body. The valve further includes a flow tube having a bore therethrough, wherein the flow tube is disposed in the tubular body to form an annular area therebetween. The valve further includes a flapper movable between an open position and a closed position in response to the movement of the flow tube. Additionally, the valve includes a sealing system constructed and arranged to substantially isolate the annular area from the bore, thereby substantially eliminating the potential of contaminants in the bore from entering into the annular area. In another aspect, a method of controlling fluid in a wellbore is provided.

16 Claims, 5 Drawing Sheets

U.S. PATENT DOCUMENTS

| | | | | |
|---|---|---|---|---|
| 4,624,315 | A | 11/1986 | Dickson et al. | |
| 4,796,705 | A | 1/1989 | Carmody et al. | |
| 4,834,183 | A | 5/1989 | Vinzant et al. | |
| 4,945,993 | A | 8/1990 | Dickson et al. | |
| 5,145,005 | A | 9/1992 | Dollison | |
| 5,167,284 | A | 12/1992 | Leismer | |
| 5,199,494 | A | 4/1993 | Williamson, Jr. | |
| 5,249,630 | A | 10/1993 | Meaders et al. | |
| 5,259,457 | A | 11/1993 | Williamson, Jr. | |
| 5,293,943 | A | 3/1994 | Williamson, Jr. | |
| 5,323,859 | A | 6/1994 | Smith et al. | |
| 5,343,955 | A | 9/1994 | Williams | |
| 5,358,053 | A | 10/1994 | Akkerman | |
| 5,564,502 | A | 10/1996 | Crow et al. | |
| 5,682,921 | A | 11/1997 | Rawswon et al. | |
| 5,799,949 | A | 9/1998 | Beall et al. | |
| 5,823,265 | A | 10/1998 | Crow et al. | |
| 5,918,858 | A | 7/1999 | Rawson et al. | |
| 6,056,055 | A | 5/2000 | Falconer et al. | |
| 6,109,351 | A | 8/2000 | Beall | |
| 6,173,785 | B1 | 1/2001 | Adams et al. | |
| 6,196,261 | B1 * | 3/2001 | Dennistoun | 137/527 |
| 6,260,850 | B1 | 7/2001 | Beall et al. | |
| 6,283,477 | B1 | 9/2001 | Beall et al. | |
| 6,296,061 | B1 | 10/2001 | Leismer | |
| 6,302,210 | B1 | 10/2001 | Crow et al. | |
| 6,328,062 | B1 | 12/2001 | Williams et al. | |
| 6,659,185 | B2 | 12/2003 | Dennistoun et al. | |
| 6,732,803 | B2 | 5/2004 | Garcia et al. | |
| 6,854,519 | B2 * | 2/2005 | Deaton et al. | 166/374 |
| 7,178,599 | B2 | 2/2007 | Anderson et al. | |
| 7,255,174 | B2 * | 8/2007 | Thompson | 166/332.8 |
| 2003/0205389 | A1 | 11/2003 | Deaton et al. | |
| 2004/0020636 | A1 | 2/2004 | Kenison et al. | |
| 2004/0026087 | A1 | 2/2004 | Dennistoun et al. | |
| 2004/0154803 | A1 | 8/2004 | Anderson et al. | |
| 2005/0016734 | A1 | 1/2005 | Thompson | |

FOREIGN PATENT DOCUMENTS

| | | |
|---|---|---|
| WO | WO 01/16461 | 3/2001 |
| WO | WO 03/054347 | 7/2003 |
| WO | WO 2005/008024 | 1/2005 |

OTHER PUBLICATIONS

Halliburton Energy Services, Inc.; WellStar; Tubing Retrievable Subsurface Safety Valve; 4 pp.; (1997).

Halliburton Energy Services, Inc.; product brochure for WellStar@Tubing-Retrievable Safety Valve; pp. 6-13 (2004).

* cited by examiner

NON-ELASTOMER CEMENT THROUGH TUBING RETRIEVABLE SAFETY VALVE

CROSS-REFERENCE TO RELATED APPLICATIONS

This application is a continuation-in-part of U.S. patent application Ser. No. 10/853,568, filed May 25, 2004, now U.S. Pat. No. 7,314,091 which claims benefit of U.S. provisional patent application Ser. No. 60/505,515, filed Sep. 24, 2003. Each of the aforementioned related patent applications is herein incorporated by reference.

BACKGROUND OF THE INVENTION

1. Field of the Invention

Embodiments of this invention are generally related to safety valves. More particularly, embodiments of this invention pertain to a non-elastomeric cement through tubing retrievable safety valve configured to control fluid flow through a production tubing string.

2. Description of the Related Art

Surface-controlled, subsurface safety valves (SCSSVs) are commonly used to shut-in oil and gas wells. Such SCSSVs are typically fitted into a production tubing in a hydrocarbon producing well and operate to selectively block the flow of formation fluids upwardly through the production tubing should a failure or hazardous condition occur at the well surface.

SCSSVs are typically configured to be rigidly connected to the production tubing (tubing retrievable) or may be installed and retrieved by wireline without disturbing the production tubing (wireline retrievable). During normal production, the subsurface safety valve is maintained in an open position by the application of hydraulic fluid pressure transmitted to an actuating mechanism. The actuating mechanism in one embodiment is charged by application of hydraulic pressure. The hydraulic pressure is commonly a clean oil supplied from a surface fluid reservoir through a control line. A pump at the surface delivers regulated hydraulic fluid under pressure from the surface to the actuating mechanism through the control line. The control line resides within the annular region between the production tubing and the surrounding well casing.

Where a failure or hazardous condition occurs at the well surface, fluid communication between the surface reservoir and the control line is broke. This, in turn, breaks the application of hydraulic pressure against the actuating mechanism. The actuating mechanism recedes within the valve, allowing the flapper to close against an annular seat quickly and with great force.

Most surface controlled subsurface safety valves are "normally closed" valves, i.e. The valve is in its closed position when the hydraulic pressure is not present. The hydraulic pressure typically works against a spring and/or gas charge acting through a piston. In many commercially available valve systems, the spring is overcome by hydraulic pressure acting against the piston, thus producing longitudinal movement of the piston. The piston, in turn, acts against an elongated "flow tube." In this manner, the actuating mechanism is a hydraulically actuated and longitudinally movable piston that acts against the flow tube to move it downward within the tubing and across the flapper.

During well production, the flapper is maintained in the open position by the force of the piston acting against the flow tube downhole. Hydraulic fluid is pumped into a variable volume pressure chamber (or cylinder) and acts against a seal area on the piston. The piston, in turn, acts against the flow tube to selectively open the flapper member in the valve. Any loss of hydraulic pressure in the control line causes the piston and actuated flow tube to retract. This, in turn, causes the flapper to rotate about a hinge pin to its valve-closed position. In this manner, the SCSSV is able to provide a shutoff of production flow within the tubing as the hydraulic pressure in the control line is released.

During well completions, certain cement operations can create a dilemma for the operator. In this respect, the pumping of cement down the production tubing and through the SCSSV presents the risk of damaging the valve. Operative parts of the valve, such as the flow tube or flapper, could become cemented into place and inoperative. At the least, particulates from the cementing fluid could invade chamber areas in the valve and cause the valve to become inoperable.

In an attempt to overcome this possibility, the voids within the valve have been liberally filled with grease or other heavy viscous material. The viscous material limits displacement of cement into the operating parts of the valve. In addition to grease packing, an isolation sleeve may be used to temporarily straddle the inner diameter of the valve and seal off the polished bore portion along the safety valve. However, this procedure requires additional trips to install the sleeve before cementing and then later remove the sleeve at completion.

Additionally, SCSSVs are typically constructed with wiper seals and/or restrictive communication members disposed around the flow tube to minimize the potential of cement from entering into the valve's operative parts. However, the valve's operative parts are not completely isolated from the bore of the SCSSV and therefore cement may enter the valve's operative parts and cause damage therein.

Therefore, a need exists for an apparatus and a method for an SCSSV that includes an improved sealing system to seal off the flow tube or other operative parts of the safety valve during a cement-through operation. There is a further need for an apparatus and a method for protecting the SCSSV from cement infiltrating the inner mechanisms of the valve during a cementing operation. Still further, there is a need for an improved SCSSV that isolates certain parts of the valve from cement infiltration during a cement-through operation, without unduly restricting the inner diameter of the safety valve for later operations.

SUMMARY OF THE INVENTION

The present invention generally relates to a non-elastomeric cement through tubing retrievable safety valve configured to control fluid flow through a production tubing string. In one aspect, a valve for use in a wellbore is provided. The valve includes a tubular body. The valve further includes a flow tube having a bore therethrough, wherein the flow tube is disposed in the tubular body to form an annular area therebetween. The valve further includes a flapper movable between an open position and a closed position in response to movement of the flow tube. Additionally, the valve includes a sealing system constructed and arranged to substantially isolate the annular area from the bore, thereby substantially eliminating the potential of contaminants in the bore from entering into the annular area.

In another aspect, a downhole valve for use in a wellbore is provided. The downhole valve includes a tubular body and a movable flow tube having a bore therethrough. The flow tube is disposed in the tubular body to form a first annular area and a second annular area therebetween. The downhole valve further includes a flapper movable between an open position and a closed position, whereby in the closed position the flapper is substantially within the second annular area. The downhole valve also includes a first sealing system for substantially isolating the first annular area from contaminates in the bore. Additionally, the downhole valve includes a second sealing system for substantially isolating the second annular area from contaminates in the bore.

In yet another aspect, a method of controlling fluid in a wellbore is provided. The method includes positioning in the wellbore a string of production tubing and a valve. The method further includes opening a flapper in response to the movement of the flow tube and then pumping cement through a bore of the production tubing and the bore of the flow tube. Additionally, the method includes substantially isolating the annular area from the cement pumped through the valve.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
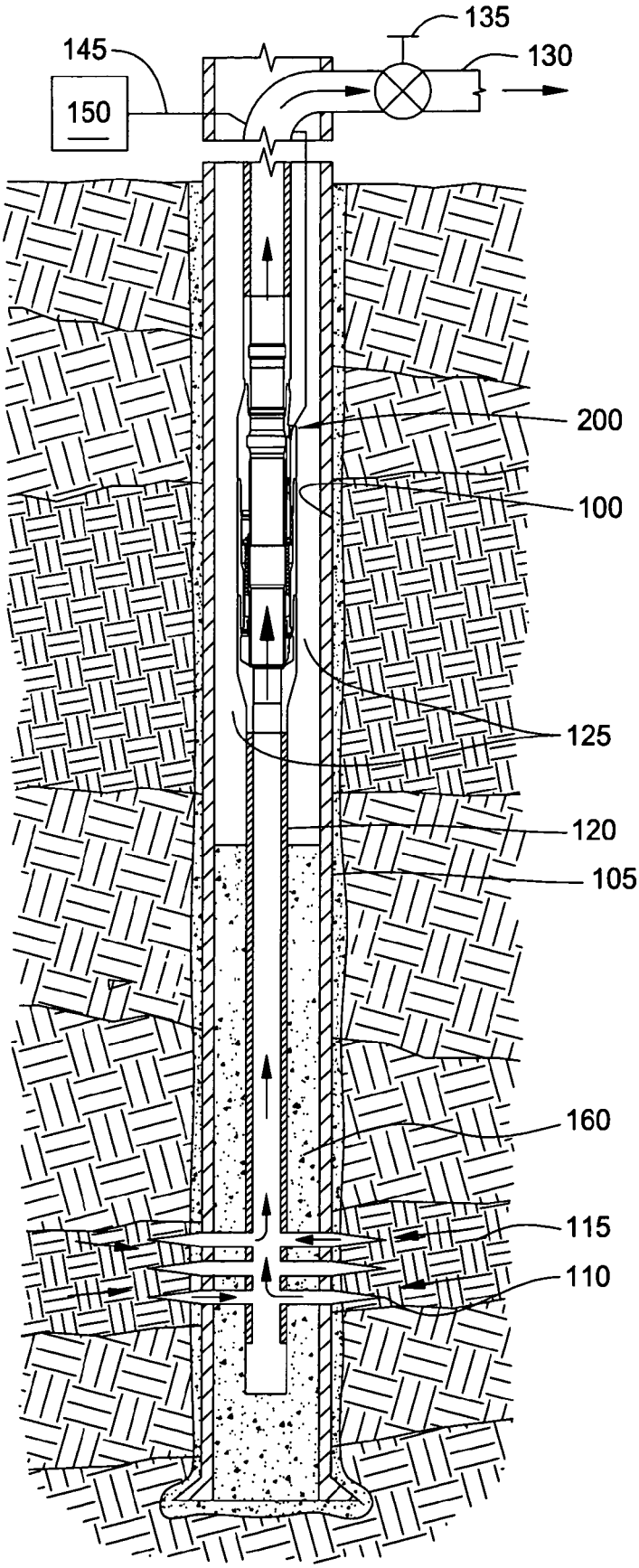
FIG. 1 is a sectional view of a wellbore illustrating a production tubing having a safety valve in accordance with an embodiment of the present invention.

The present invention is generally directed to a tubing-retrievable subsurface safety valve for controlling fluid flow in a wellbore. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features described below. One of normal skill in the art of subsurface safety valves will appreciate that the various embodiments of the invention can and may be used in all types of subsurface safety valves, including but not limited to tubing retrievable, wireline retrievable, injection valves, or subsurface controlled valves.

For ease of explanation, the invention will be described generally in relation to a cased vertical wellbore. It is to be understood, however, that the invention may be employed in an open wellbore, a horizontal wellbore, or a lateral wellbore without departing from principles of the present invention. Furthermore, a land well is shown for the purpose of illustration; however, it is understood that the invention may also be employed in offshore wells or extended reach wells that are drilled on land but completed below an ocean or lake shelf.

FIG. 1 presents a sectional view of an illustrative wellbore 100 with a string of production tubing 120 disposed therein. The production tubing 120 defines an elongated bore through which fluids may be pumped downward, or pumped, or otherwise produced upward. The production tubing 120 includes a safety valve 200 in accordance with an embodiment of the present invention. The safety valve 200 is used for selectively controlling the flow of fluid in the production tubing 120. The valve 200 may be moved between an open position and a closed position by operating a control 150 in communication with the valve 200 through a line 145. The operation of the valve 200 is described in greater detail below in connection with FIGS. 2-5.

During the completion operation, the wellbore 100 is lined with a string of casing 105. Thereafter, the production tubing 120, with the safety valve 200 disposed in series, is deployed in the wellbore 100 to a predetermined depth. In connection with the completion operation, the production tubing 120 is cemented in situ. To accomplish this, a column of cement is pumped downward through the bore of the production tubing 120. Cement is urged under pressure through the open safety valve 200, through the bore of the tubing 120, and then into an annulus 125 formed between the tubing 120 and the surrounding casing 105. Preferably, the cement 160 will fill the annulus 125 to a predetermined height, which is proximate to or higher than a desired zone of interest in an adjacent formation 115.

After the cement 160 is cured, the formation 115 is opened to the bore of the production tubing 120 at the zone of interest. Typically, perforation guns (not shown) are lowered through the production tubing 120 and the valve 200 to a desired location proximate the formation 115. Thereafter, the perforation guns are activated to form a plurality of perforations 110, thereby establishing fluid communication between the formation 115 and the production tubing 120. The perforation guns can be removed or dropped off into the bottom of the wellbore below the perforations. Hydrocarbons (illustrated by arrows) may subsequently flow into the production tubing 120, through the open safety valve 200, through a valve 135 at the surface, and out into a production flow line 130.

During this operation, the valve 200 preferably remains in the open position. However, the flow of hydrocarbons may be stopped at any time during the production operation by switching the valve 200 from the open position to the closed position. This may be accomplished either intentionally by having the operator remove the hydraulic pressure applied through the control line 145 or through a catastrophic event at the surface such as an act of terrorism. The valve 200 is demonstrated in its open and closed positions in connection with FIGS. 2-5.

Figure 2:
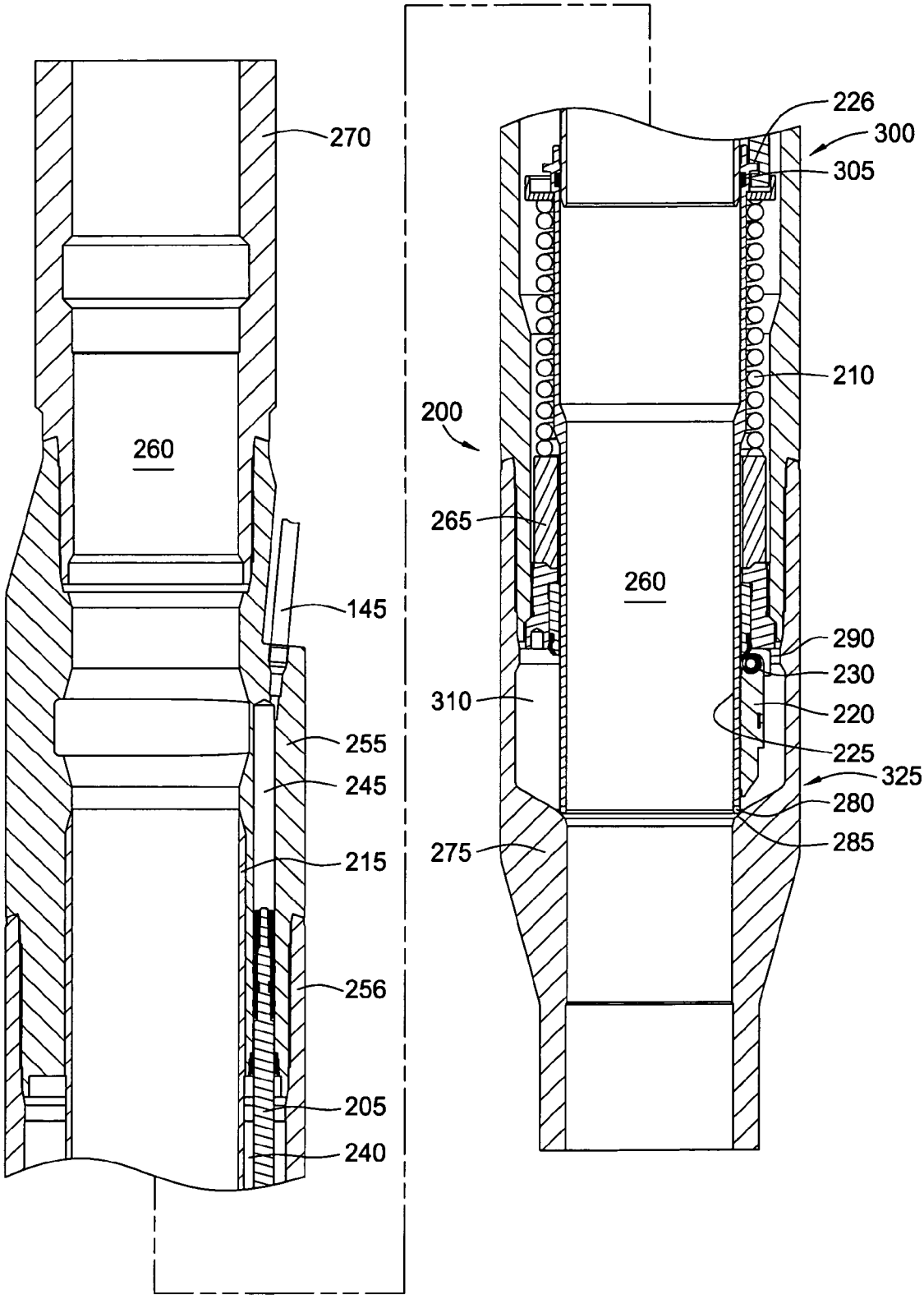
FIG. 2 provides a sectional view of a tubing-retrievable safety valve in an open position.

FIG. 2 presents a cross-sectional view illustrating the safety valve 200 in its open position. A bore 260 in the valve 200 allows fluids such as uncured cement to flow down through the valve 200 during the completion operation. In a similar manner, the open valve 200 allows hydrocarbons to flow up through the valve 200 during a normal production operation.

The valve 200 includes a top sub 270 and a bottom sub 275. The top 270 and bottom 275 subs are threadedly connected in series with the production tubing (shown in FIG. 1). The valve 200 further includes a housing 255 disposed intermediate the top 270 and bottom 275 subs. The housing 255 defines a tubular body that serves as a housing for the valve 200. The housing 255 preferably includes a chamber 245 in fluid communication with a hydraulic control line 145. The hydraulic control line 145 carries fluid such as clean oil from a reservoir down to the chamber 245.

In the arrangement of FIG. 2, the chamber 245 is configured to receive a piston 205. The piston 205 typically defines a small diameter piston which is movable within the chamber 245 between an upper position and a lower position. Movement of the piston 205 is in response to hydraulic pressure from the line 145. It is within the scope of the present invention, however, to employ other less common actuators such as electric solenoid actuators, motorized gear drives, and gas charged valves (not shown). Any of these known or contemplated means of actuating the subsurface safety valve 200 of the present invention may be employed.

Figure 5:
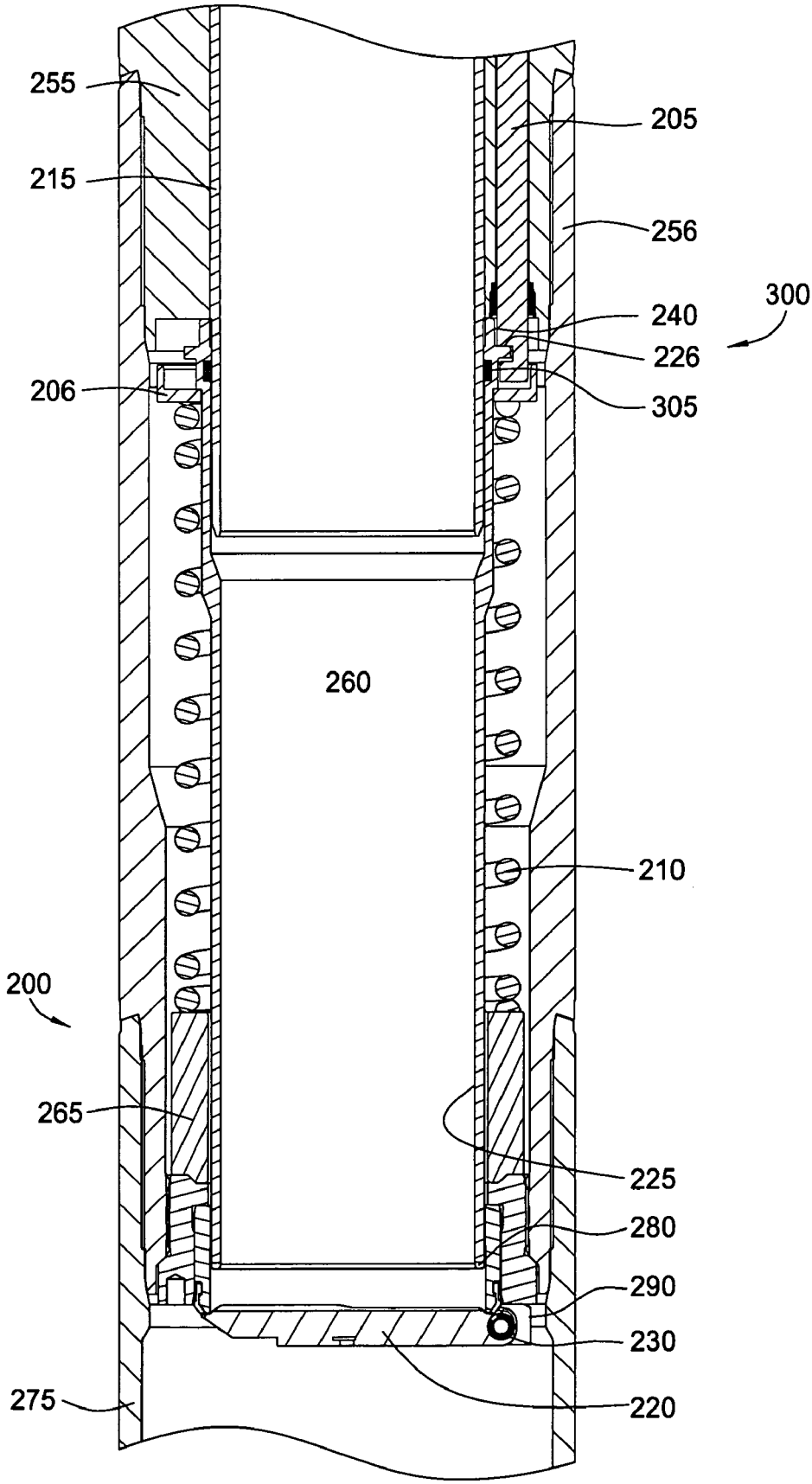
FIG. 5 is an enlarged sectional view of the safety valve of FIG. 4.

As illustrated in FIG. 2, the valve 200 also may include a biasing member 210. Preferably, the biasing member 210 defines a spring. The biasing member 210 resides in the housing 255 below the piston 205. In one optional aspect, the lower portion of the housing 255 defines a connected spring housing 256 for receiving the biasing member 210. A lower end of the biasing member 210 abuts a spring spacer 265 that is adjacent to the spring housing 256. An upper end of the biasing member 210 abuts a lower end of the piston 205. The spring operates in compression to bias the piston 205 upward. Movement of the piston 205 from the upper position to the lower position compresses the biasing member 210 against the spring spacer 265. In the arrangement of FIG. 5, an annular shoulder 206 is provided as a connector between the piston 205 and the biasing member 210.

Disposed below the spring spacer 265 is a flapper 220. The flapper 220 is rotationally attached by a pin 230 to a flapper mount 290. The flapper 220 pivots between an open position and a closed position in response to movement of a flow tube 225. A shoulder 226 is provided for a connection between the piston 205 and the flow tube 225. In the open position, a fluid pathway is created through the bore 260, thereby allowing the flow of fluid through the valve 200. Conversely, in the closed position, the flapper 220 blocks the fluid pathway through the bore 260, thereby preventing the flow of fluid through the valve 200.

Further illustrated in FIG. 2, a lower portion of the flow tube 225 is disposed adjacent the flapper 220. The flow tube 225 is movable longitudinally along the bore 260 of the housing 255 in response to axial movement of the piston 205. Axial movement of the flow tube 225, in turn, causes the flapper 220 to pivot between its open and closed positions. In the open position, the flow tube 225 blocks the movement of the flapper 220, thereby causing the flapper 220 to be maintained in the open position. In the closed position, the flow tube 225 allows the flapper 220 to rotate on the pin 230 and move to the closed position. It should also be noted that the flow tube 225 substantially eliminates the potential of contaminants, such as cement, from interfering with the critical workings of the valve 200. However, it is desirable that additional means be provided for preventing contact by cement with the flapper 220 and other parts of the valve 200, including the flow tube 225 itself. To this end, the valve 200 also includes a sleeve 215 which is disposed adjacent the housing 255.

Each of FIGS. 2-5 shows an isolation sleeve 215 adjacent to the bore 260 of the valve 200. The sleeve 215 serves to isolate the bore 260 of the valve from at least some operative parts of the valve 200. In other words, the sleeve 215 acts as a sealing member to substantially eliminate the potential of contaminants in the bore 260, such as cement, from entering into the annular area 240. The sleeve 215 has an inner diameter and an outer diameter. The inner diameter forms a portion of the bore 260 of the valve, while the outer diameter provides an annular area 240 vis-a-vis the inner diameter of the tubular housing 255. The sleeve 215 maybe press fit or sealed into the housing 255.

As illustrated in FIG. 2, the valve 200 includes a first sealing system 300. The primary reason for the first sealing system 300 is to substantially eliminate the potential of contaminants in the bore 260, such as cement, from entering into the annular area 240. The first sealing system 300 includes a seal member 305 disposed between the sleeve 215 and the movable flow tube 225. Typically, the seal member 305 creates a fluid seal between the flow tube 225 and the stationary sleeve 215.

In one embodiment, the seal member 305 is placed in a groove (not shown) in an upper end of the flow tube 225. In this respect, the movement of the piston 205 in response to the hydraulic pressure in the line 145 would also cause the seal member 305 and the flow tube 225 to move. In so moving, the seal member 305 would traverse upon the outer diameter of the isolation sleeve 215. Alternatively, the seal member 305 is fixed along the outer diameter of the sleeve 215 and therefore would remain stationary relative to the movable flow tube 225. The seal member 305 is typically made from a non-elastomeric material such as PTFE or another type of polymer. Where the seal member 305 is provided, the isolation sleeve 215 fluidly seals an inside of the chamber housing 255. In an alternative embodiment, the sleeve 215 could be machined integral to the housing 255.

Figure 3:
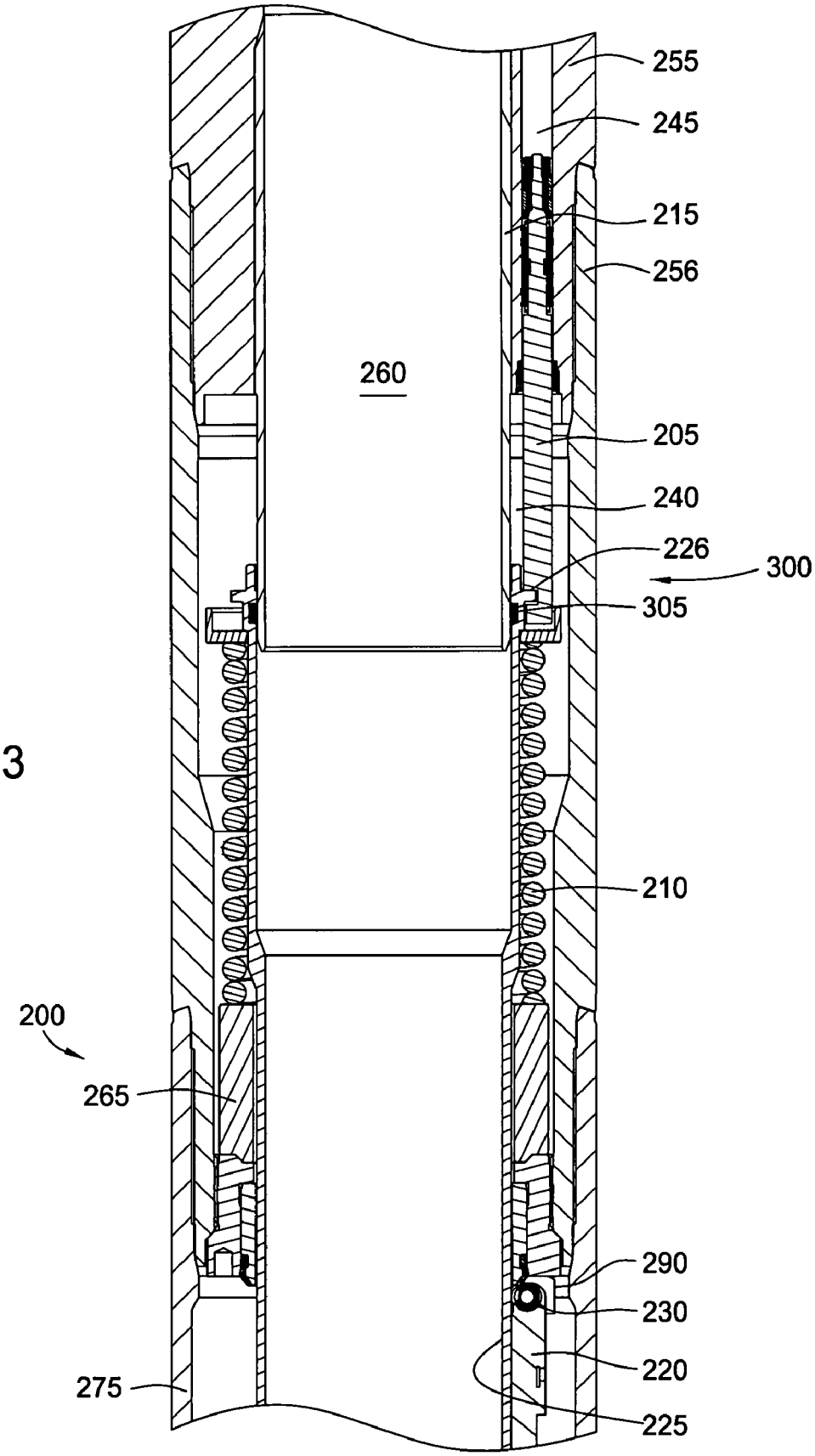
FIG. 3 is an enlarged sectional view of the safety valve of FIG. 2.

The valve 200 includes a second sealing system 325. The primary reason for the second sealing system 325 is to substantially eliminate the potential of contaminants in the bore 260, such as cement, from entering into an annular area 310 adjacent the flapper 220 while the valve 200 is in the open position (seen in FIGS. 2 and 3). The second sealing system 325 is formed between an end 280 of the flow tube 225 and a shoulder 285 formed on the bottom sub 275. As shown in FIG. 3, the valve 200 in the open position allows the end 280 to contact the shoulder 285 to form a substantially fluid seal between the flow tube 225 and the bottom sub 275. This metal to metal contact between the flow tube 225 and the bottom sub 275 substantially prevents contaminants in the bore 260 from entering into an annular area 310 adjacent the flapper 220.

FIG. 3 presents an enlarged cross-sectional view of a portion of the safety valve 200 of FIG. 2. The flow tube 225 is more visible here. Again, the flow tube 225 is positioned to maintain the safety valve 200 in its open position. This position allows cement or other fluids to flow down through the bore 260 during completion operations, and allows hydrocarbons to flow up through the bore 260 during production. In either case, the flow tube 225 also protects various components of the valve 200, such as the biasing member 210 and the flapper 220, from cement or contaminants that will flow through the bore 260. Furthermore, the flow tube 225 in the open position prevents the flapper 220 from moving from the open position to the closed position.

Typically, the flow tube 225 remains in the open position throughout the completion operation and later production. However, if the flapper 220 is closed during the production operation, it may be reopened by moving the flow tube 225 back to the open position. Generally, the flow tube 225 moves to the open position as the piston 205 moves to the lower position and compresses the biasing member 210 against the spring spacer 265. Typically, fluid from the line (not shown) enters the chamber 245, thereby creating a hydraulic pressure on the piston 205. As more fluid enters the chamber 245, the hydraulic pressure continues to increase until the hydraulic pressure on the upper end of the piston 205 becomes greater than the biasing member 210 on the lower end of the piston 205. At that point, the hydraulic pressure in the chamber 245 causes the piston 205 to move to the lower position. Since the flow tube 225 is operatively attached to the piston 205, the movement of the piston 205 causes longitudinal movement of the flow tube 225 and the seal member 305.

Figure 4:
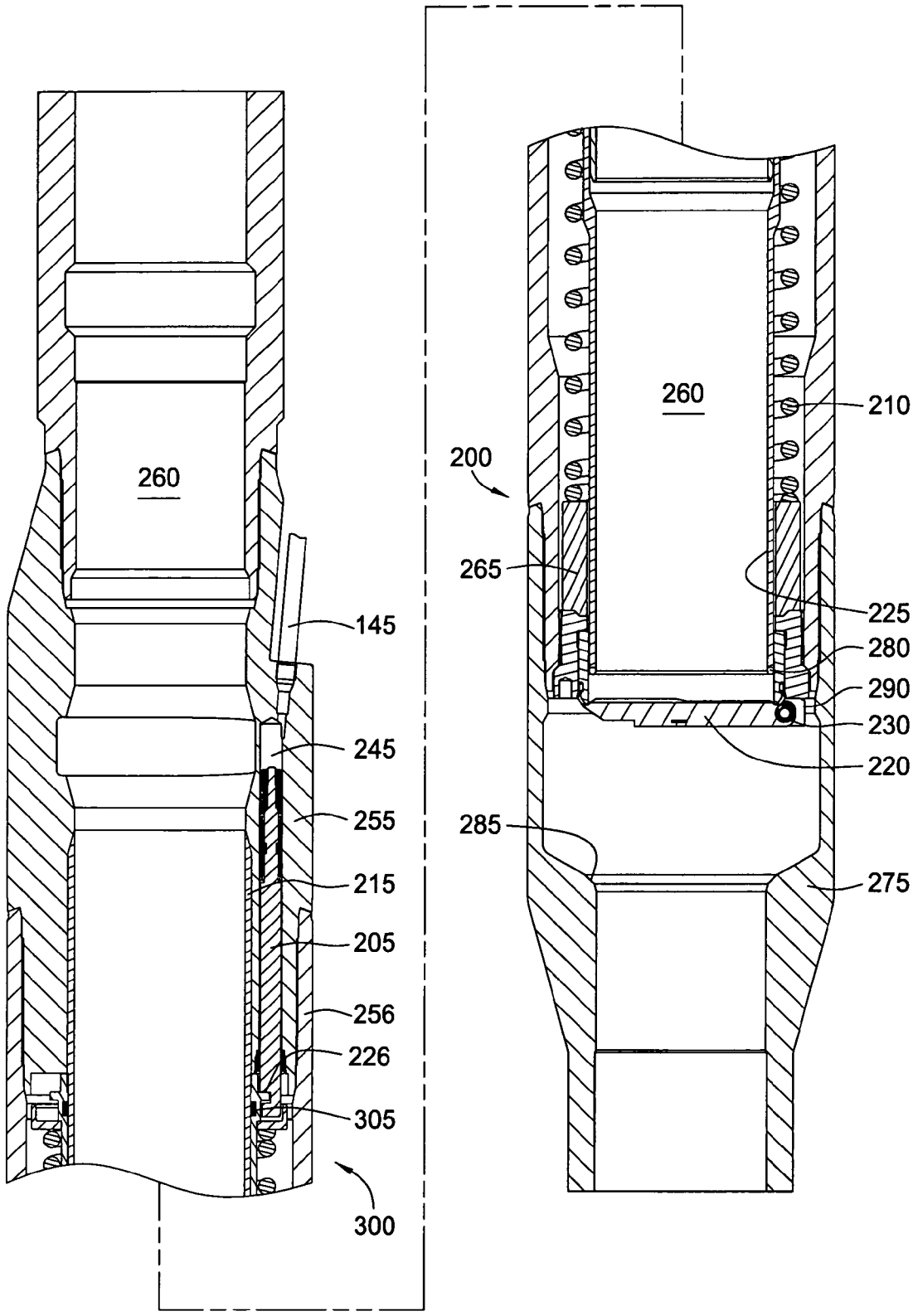
FIG. 4 is a sectional view illustrating the tubing-retrievable safety valve in a closed position.

FIG. 4 is a cross-sectional view illustrating the tubing-retrievable safety valve 200 of FIG. 2 in its closed position. Generally, in the production operation, fluid flow through the production tubing may be controlled by preventing flow through the valve 200. More specifically, the flapper 220 seals off the bore 260, thereby preventing fluid communication through the valve 200.

During closure, fluid in the chamber 245 exits into the line 145, thereby decreasing the hydraulic pressure on the piston 205. As more fluid exits the chamber 245, the hydraulic pressure continues to decrease until the hydraulic pressure on the upper end of the piston 205 becomes less than the opposite force on the lower end of the piston 205. At that point, the force created by the biasing member 210 causes the piston 205 to move to the upper position. Since the flow tube 225 is operatively attached to the piston 205, the movement of the piston 205 causes the movement of flow tube 225 and the seal member 305 into the annular area 240 until the flow tube 225 is substantially disposed within the annular area 240. In this manner, the flow tube 225 is moved to the closed position.

FIG. 5 is an enlarged cross-sectional view illustrating the flow tube 225 in the closed position. Here, the piston 205 is raised within the chamber 245. In this respect, the biasing member 210 of FIG. 5 is seen expanded vis-a-vis the biasing member 210 of FIG. 3. This indicates that the biasing action of the biasing member 210 has overcome the piston 205. As the piston 205 is raised, the connected flow tube 225 is also raised. This moves the lower end of the flow tube 225 out of its position adjacent the flapper 220. This, in turn, allows the flapper 220 to pivot into its closed position. In this position, the bore 260 of the valve 200 is sealed, thereby preventing fluid communication through the valve 200. More specifically, flow tube 225 in the closed position no longer blocks the movement of the flapper 220, thereby allowing the flapper 220 to pivot from the open position to the closed position and seal the bore 260.

Although the invention has been described in part by making detailed reference to specific embodiments, such detail is intended to be and will be understood to be instructional rather than restrictive. It should be noted that while embodiments of the invention disclosed herein are described in connection with a subsurface safety valve, the embodiments described herein may be used with any well completion equipment, such as a packer, a sliding sleeve, a landing nipple, and the like.

While the foregoing is directed to embodiments of the present invention, other and further embodiments of the invention may be devised without departing from the basic scope thereof, and the scope thereof is determined by the claims that follow.

The invention claimed is:

1. A valve for use in a wellbore, the valve comprising:

a tubular body;

a flow tube having a bore therethrough, the flow tube disposed in the tubular body to form an annular area therebetween;

a stationary sleeve disposed in the tubular body, wherein the stationary sleeve is coaxially arranged relative to the flow tube and wherein a portion of the flow tube is configured to move along an outer surface of the stationary sleeve;

a flapper movable between an open position and a closed position in response to movement of the flow tube;

a sealing system disposed between the flow tube and the stationary sleeve, the sealing system configured to substantially isolate the annular area from the bore, thereby substantially eliminating the potential of contaminants in the bore from entering into the annular area; and a second sealing system that is formed when an end of the flow tube directly lands on a shoulder of the tubular body when the flapper is in the open position.

2. The valve of claim 1, wherein the sealing system is operatively attached to the flow tube and moveable therewith.

3. The valve of claim 1, wherein the sealing system includes a seal member disposed between the flow tube and the stationary sleeve.

4. The valve of claim 3, wherein the seal member is made from PTFE.

5. The valve of claim 1, wherein the end of the flow tube includes a formed surface for mating and forming a seal with the shoulder of the tubular body.

6. The valve of claim 1, further including a piston disposed in the annular area, wherein the piston acts against a biasing member to shift the flow tube to the open position in response to hydraulic pressure.

7. The valve of claim 6, wherein the biasing member is disposed in the annular area.

8. The valve of claim 1, wherein the tubular body includes a lower sub, whereby the shoulder is formed on a portion of the lower sub.

9. A downhole valve for use in a wellbore, the valve comprising:

a tubular body;

a movable flow tube having a bore therethrough, the flow tube disposed in the tubular body to form a first annular area and a second annular area therebetween;

a stationary sleeve disposed in the tubular body, wherein the stationary sleeve is coaxially arranged relative to the flow tube and wherein a portion of the flow tube moves along an outer diameter of the stationary sleeve;

a flapper movable between an open position and a closed position, whereby in the closed position the flapper is substantially within the second annular area;

a first sealing system disposed between the flow tube and the stationary sleeve and configured for substantially isolating the first annular area from contaminates in the bore; and a second sealing system for substantially isolating the second annular area from contaminates in the bore, wherein the second sealing system is formed when an end of the flow tube directly lands on a shoulder of the tubular body.

10. The valve of claim 9, wherein the first sealing system includes a seal member disposed between the flow tube and the stationary sleeve.

11. The valve of claim 9, wherein the end of the flow tube includes a formed surface for mating and forming a seal with the shoulder of the tubular body.

12. The valve of claim 9, wherein the tubular body includes a lower sub, whereby the shoulder is formed on a portion of the lower sub.

13. The valve of claim 9, wherein the first sealing system includes a seal member that is attached to the portion of the flow tube that moves along the stationary sleeve.

14. A method of controlling fluid in a wellbore, comprising:

positioning in the wellbore a string of production tubing and a valve, the valve comprising:

a tubular body;

a flow tube having a bore therethrough, the flow tube disposed in the tubular body to form an annular area therebetween;

a stationary sleeve disposed in the tubular body;

a flapper movable between an open position and a closed position; and a sealing system;

opening the flapper in response to movement of the flow tube, wherein a portion of the flow tube moves along an outer surface of the stationary sleeve;

forming a seal as an end of the flow tube directly lands on a shoulder of the tubular body when the flapper is in the open position;

pumping cement through a bore of the production tubing and the bore of the flow tube; and substantially isolating the annular area from the cement pumped through the valve.

15. The method of claim 14, further including providing fluid isolation between the bore of the flow tube and a selected formation in the wellbore.

16. The method of claim 14, wherein the sealing system includes a seal member disposed between the flow tube and the stationary sleeve.

* * * * *